US006948444B2

(12) United States Patent
Stinson

(10) Patent No.: US 6,948,444 B2
(45) Date of Patent: Sep. 27, 2005

(54) HULL REINFORCING SYSTEM

(75) Inventor: Alan Stinson, Gallatin, TN (US)

(73) Assignee: Stratos Boats, Inc., Murfreesboro, TN (US)

( * ) Notice: Subject to any disclaimer, the term of this patent is extended or adjusted under 35 U.S.C. 154(b) by 0 days.

(21) Appl. No.: 10/439,821

(22) Filed: May 16, 2003

(65) Prior Publication Data

US 2004/0226500 A1 Nov. 18, 2004

(51) Int. Cl.[7] ..... B63B 5/24
(52) U.S. Cl. ..... 114/357; 114/56.1
(58) Field of Search ..... 114/56.1, 355, 114/357

(56) References Cited

U.S. PATENT DOCUMENTS

| | | | | |
|---|---|---|---|---|
| 2,617,126 A | | 11/1952 | Nebesar | |
| 2,909,791 A | | 10/1959 | Malary, Jr. | |
| 3,435,470 A | * | 4/1969 | Krenzler | 114/357 |
| 3,711,581 A | | 1/1973 | Fowler, Jr. et al. | |
| 3,840,926 A | | 10/1974 | Stoeberl | |
| 3,848,284 A | | 11/1974 | Livingston | |
| 4,120,632 A | | 10/1978 | Stoeberl | |
| 4,214,332 A | | 7/1980 | Stoner | |
| 4,910,067 A | | 3/1990 | O'Neill | |
| 5,036,789 A | | 8/1991 | Kelly et al. | |
| 5,036,790 A | | 8/1991 | Berryer | |
| 5,063,870 A | | 11/1991 | Wagner | |
| 5,253,607 A | | 10/1993 | Chen | |
| 5,433,165 A | | 7/1995 | McGuiness et al. | |
| 5,458,844 A | | 10/1995 | MacDougall | |
| 5,526,767 A | | 6/1996 | McGuiness et al. | |
| 5,558,038 A | | 9/1996 | McNamara | |
| 5,588,392 A | | 12/1996 | Bailey | |
| 5,634,425 A | | 6/1997 | MacDougall | |
| 5,699,750 A | | 12/1997 | Schneider | |
| 5,787,836 A | | 8/1998 | Blaisdell et al. | |
| 6,032,606 A | * | 3/2000 | Fulks | 114/357 |
| 6,286,448 B1 | | 9/2001 | Sahr et al. | |
| 6,367,406 B1 | | 4/2002 | Sahr et al. | |

FOREIGN PATENT DOCUMENTS

| | | | | |
|---|---|---|---|---|
| JP | 57-80980 | * | 5/1982 | 114/357 |

OTHER PUBLICATIONS

Admitted Prior Art, Bass Boat Stringer, 1 pg. (Oct. 28, 2002).

Admitted Prior Art, Bass Boat Stringer, 5 pgs., date unknown.

* cited by examiner

*Primary Examiner*—Sherman Basinger
(74) *Attorney, Agent, or Firm*—Merchant & Gould P.C.

(57) ABSTRACT

A system for reinforcing a boat hull is disclosed herein. The system includes two longitudinal supports positioned on opposite sides of a keel of the hull. A bridge structure extends across the keel and interconnects the longitudinal supports.

35 Claims, 6 Drawing Sheets

HULL REINFORCING SYSTEM

TECHNICAL FIELD

The present invention relates generally to systems for reinforcing boat hulls. More particularly, the present invention relates to fiberglass stringer systems for reinforcing fiberglass boat hulls.

BACKGROUND

Boat hulls can be manufactured from a number of different materials including materials such as fiberglass reinforced resin, aluminum and wood. To improve performance and durability, it is common for a boat hull to be reinforced with a grid or framework of reinforcing/support members positioned within the hull. The framework typically includes longitudinal support members that extend along the length of the hull. These types of supports are often referred to as stringers. The framework also includes support members that extend across the width of the hull. These type of support members are typically referred to as bulkheads. Example hull reinforcing systems are disclosed in U.S. Pat. Nos. 3,848,284; 6,367,406; and 6,286,448.

SUMMARY

One inventive aspect of the present disclosure relates a system for reinforcing a hull, the system including longitudinal supports that define channels having open sides that face in an upward direction, and bottom walls that are bonded to the hull.

Another inventive aspect of the present disclosure relates to a reinforcing system including longitudinal supports that are interconnected by a bridge structure that extends along at least 50 percent of the length of each of the longitudinal supports.

A further inventive aspect of the present disclosure relates to a hull reinforcing system including first and second longitudinal supports interconnected by a middle support that extends along at least 50 percent of the length of each of the first and second longitudinal supports. The middle support defines at least one transverse slot in which a cross-brace is positioned.

Examples of a variety of inventive aspects in addition to those described above are set forth in the description that follows. It is to be understood that both the foregoing general description and the following detailed description are exemplary and explanatory only and are not restrictive of the broad inventive aspects that underlie the examples disclosed herein.

DETAILED DESCRIPTION

As used herein, the term "longitudinal" refers to a direction that extends generally along or generally parallel to the keel of a boat. Also, the term "transverse" refers to a direction that extends across or generally perpendicular to the keel of a boat. Further, the terms "inner" and "outer" are specified relative to the keel of a boat.

Figure 1:
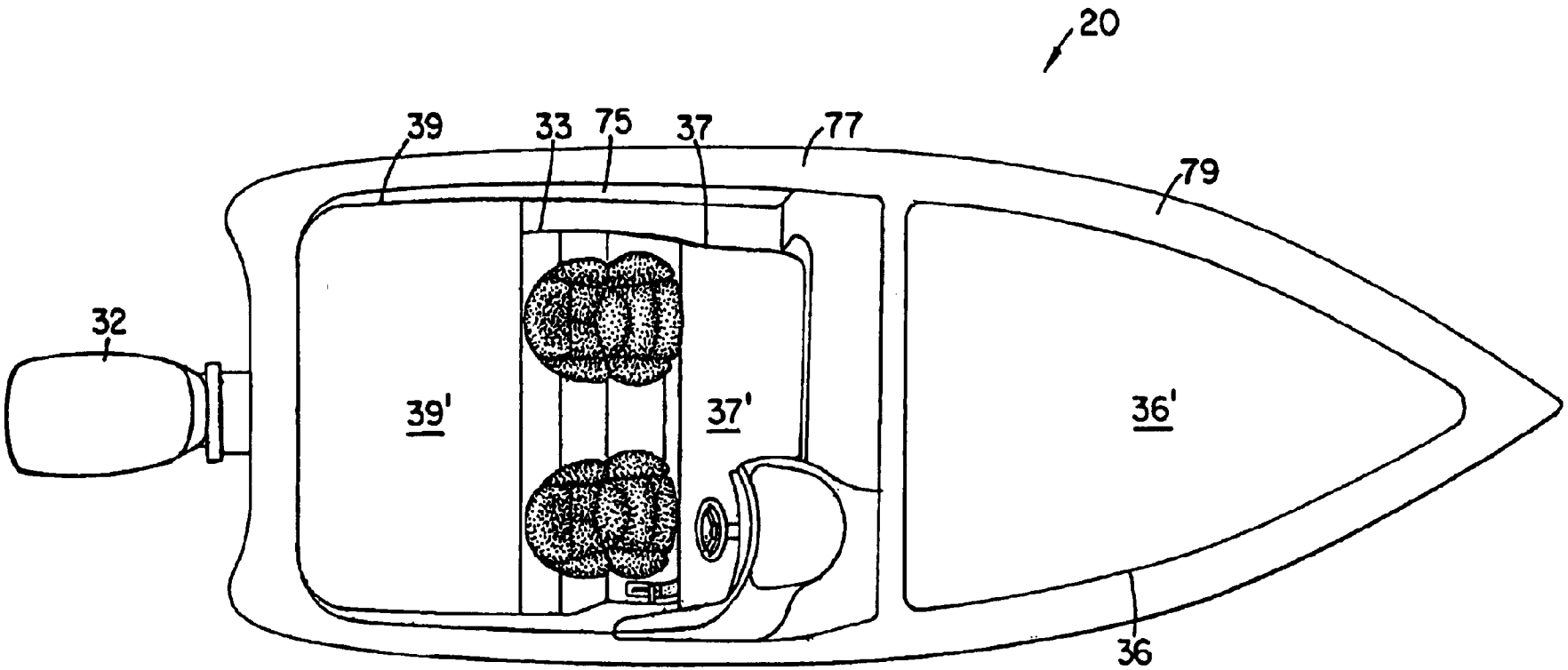
FIG. 1 is a top, plan view of an example boat suitable for using a hull reinforcing system in accordance with the principles of the present disclosure.

Referring now to FIG. 1, an example boat 20 is shown. The boat 20 is one example of a type of boat in which a hull reinforcing system having inventive features in accordance with the principles of the present disclosure can be used. The boat 20 is depicted as a bass boat having an outboard motor 32, an integrated rear bucket seat unit 33, a steering console 34, a recessed cockpit 37, a raised front casting deck 36 and a raised rear casting deck 39. While the example boat 20 has been depicted as a bass boat, it will be appreciated that the various inventive aspects, examples of which are disclosed herein, are applicable to any type of hull in need of hull reinforcement.

Figure 2:
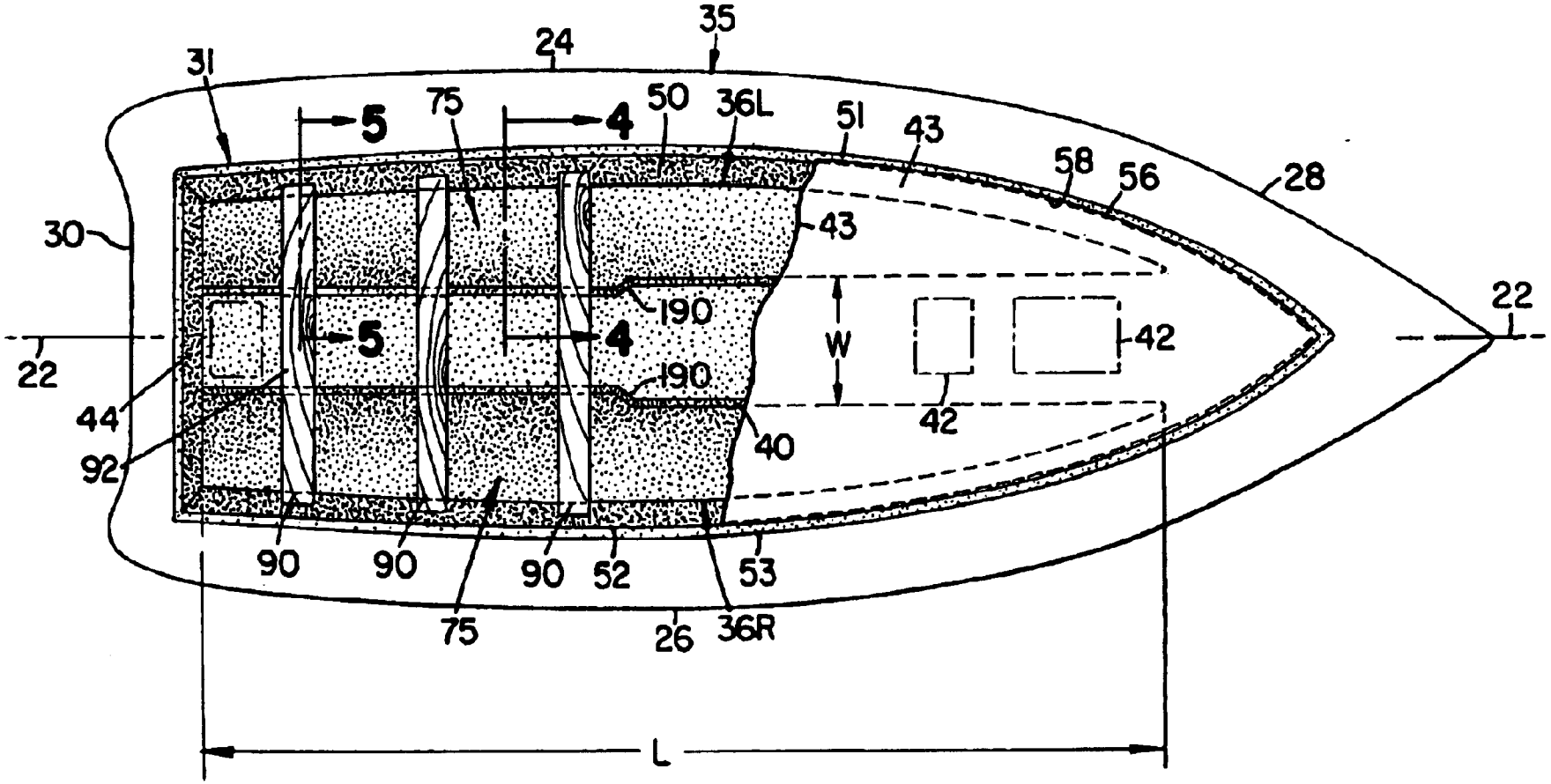
FIG. 2 is a plan view of the boat of FIG. 1 with the top deck and flooring removed to show an example hull reinforcing system in accordance with the principles of the present disclosure.

FIG. 2 shows the boat 20 of FIG. 1 with the top deck removed to reveal the inside of a hull 35 of the boat 20. The hull 35 includes a central keel that extends along a keel line 22. The hull 35 also includes a port side 24, a starboard side 26, a bow 28 and a stern 30.

Referring still to FIG. 2, a majority of a floor structure 43 of the boat 20 has been cut away to reveal a hull reinforcing system having features that are examples of inventive aspects in accordance with the principles of the present disclosure. The reinforcing system includes a stringer unit 31 and cross-braces 90 (i.e., bulkheads). The cross-braces 90 extend across the width of the hull 35 and are mounted within transverse notches 92 defined by the stringer unit 31. The stringer unit 31 includes left and right longitudinal supports 36L, 36R positioned on opposite sides of the keel line 22, and a middle bridge structure 40 that interconnects the longitudinal supports 36L, 36R. The middle bridge structure 40 extends over (i.e., bridges or spans) the keel line 22. The stringer unit 31 also includes a port floor support structure 50 that couples the left longitudinal support 36L to the port side of the hull 35, and a starboard floor support structure 52 that couples the right longitudinal support 36R to the starboard side 26 of the hull 35. The stringer unit 31 further includes a front nose portion 56 that nests into the bow 28 of the hull 35.

A. Longitudinal Supports of Stringer Unit

The longitudinal supports 36L, 36R of the stringer unit 31 can also be referred to as "stringers" or "longitudinal reinforcing structures." The left longitudinal support 36L is positioned between the keel line 22 and the port side 24 of the boat 20, and the right longitudinal support 36R is positioned between the keel line 22 and the starboard side 26 of the boat 20. Each of the longitudinal supports 36L, 36R extends from the stern 30 to the bow 28 of the boat 20, and has a length that is generally parallel to the keel line 22.

Figure 3:
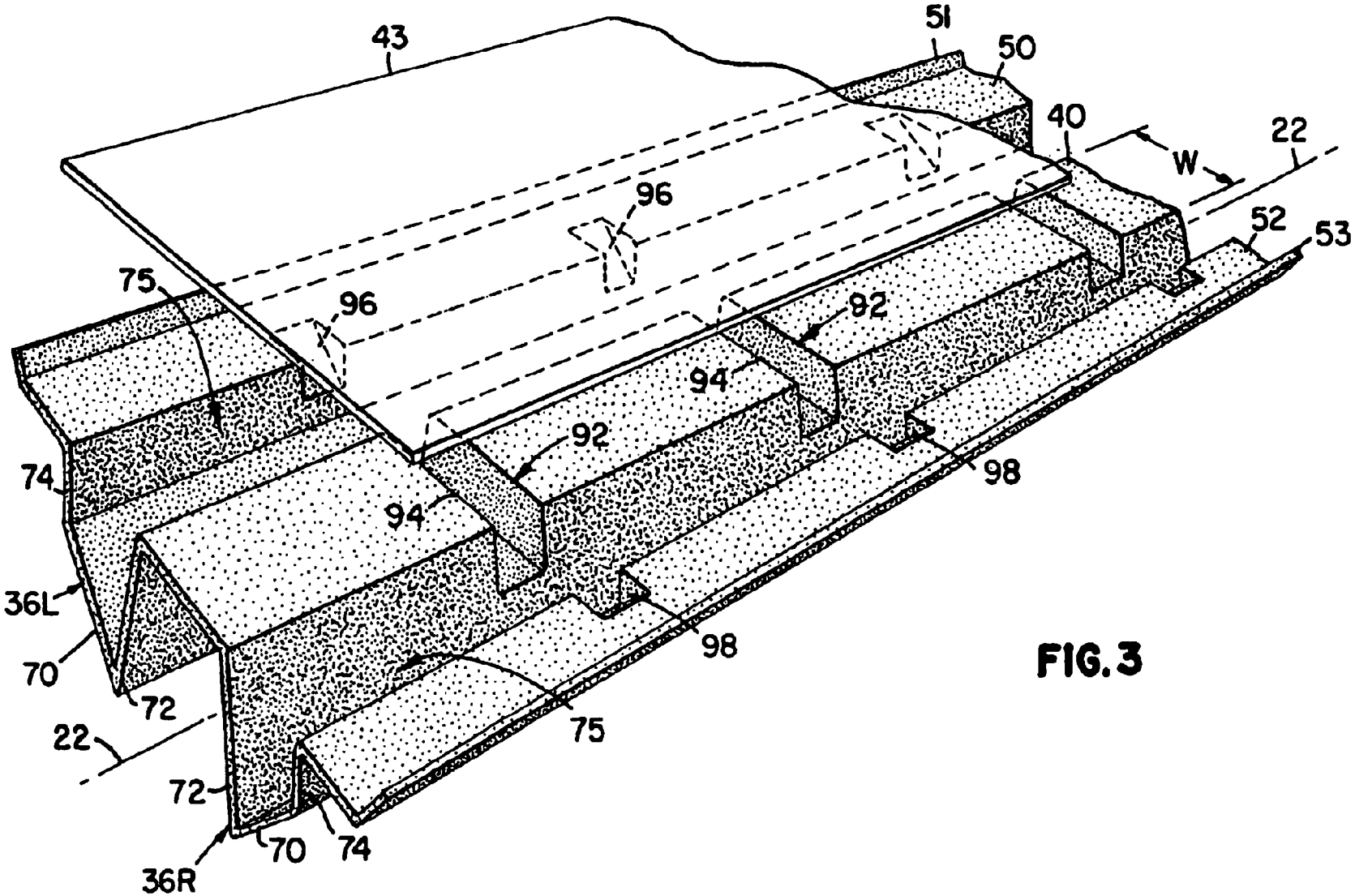
FIG. 3 is a perspective view of a portion of the hull reinforcing system of FIG.2.

Referring to FIG. 3, the left and right longitudinal supports 36L, 36R each include a bottom wall 70, an inner wall 72, and an outer wall 74. The bottom walls 70 cooperate with the inner and outer walls 72, 74 to define channels 75 having open sides that face in an upward direction. The channels 75 of the longitudinal supports 36L, 36R have lengths that extend from stem 30 to bow 28 in a direction generally parallel to the keel line 22. As shown in FIG. 2, the channels 75 have transverse widths that gradually become narrower as the longitudinal supports 36L, 36R extend from a mid-region of the hull 35 toward the bow 28 of the hull 35.

Figure 4:
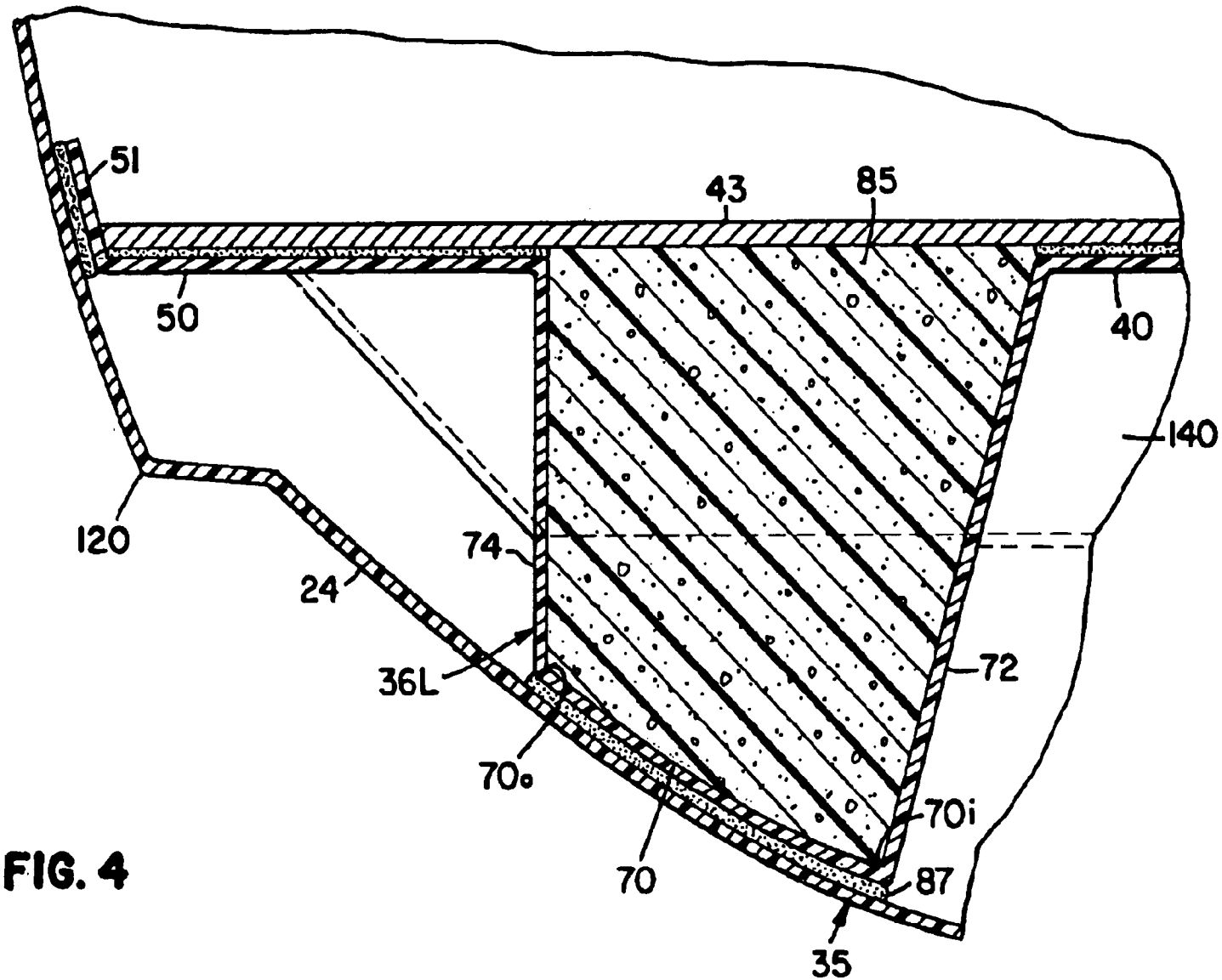
FIG. 4 is a cross-sectional view taken along section line 4—4 of FIG. 2.

FIG. 4 shows the left longitudinal support 36L in relation to the port side of the hull 35. Referring to FIG. 4, the bottom wall 70 of the left longitudinal support 36L extends along the port side 24 of the hull 35 and is bonded to the hull (e.g., with an adhesive, epoxy, resin or other bonding compound 87). In one embodiment, methacrylate adhesive is used to bond the bottom wall 70 of the longitudinal supports 36L, 36R to the hull 35.

The bottom wall 70 includes inner and outer ends 70*i* and 70*o*. The inner wall 72 is connected to the inner end 70*i* of the bottom wall 70, and extends from the bottom wall 70 upwardly away from the port side 24 of the hull 35. The outer wall 74 is connected to the outer end 70*o* of the bottom wall 70 and extends from the bottom wall 70 upwardly away from the port side 24 of the hull 35. The hull 35 and stringer unit 31 are symmetrical about the keel line 22. Thus, while not depicted in FIG. 4, it will be appreciated that the bottom wall 70 of the right longitudinal support 36R is bonded to the starboard side 26 of the hull 35, and the inner and outer walls 72, 74 of the right longitudinal support 36R extend from the bottom wall 70 of the right longitudinal support 36R upwardly away from the starboard side 26 of the hull 35.

B. Middle Bridge Structure of Stringer Unit

The middle bridge structure 40 of the stringer unit 31 structurally couples the left longitudinal support 36L to the right longitudinal support 36R. As shown in FIG. 3, the middle bridge structure 40 connects to upper ends of the inner walls 72 of the left and right longitudinal supports 36L, 36R, and includes a width W that extends in a transverse direction across the keel line 22. Referring to FIG. 2, the width W of the middle bridge structure is greater adjacent the bow 28 than adjacent the stern 30 of the hull 35. An inwardly/outwardly stepped region 190 provides this variation in the width W. The increased width facilitates mounting of storage boxes at openings 42 defined through the bridge structure. In other embodiments, the stepped region need not be present.

The middle bridge structure 40 has a length L in a longitudinal direction that is preferably greater than the width W. In a preferred embodiment, the middle bridge structure 40 extends along at least 50 percent of the length of each of the longitudinal supports 36L, 36R, thereby providing inner support along a majority of the length of each of the longitudinal supports 36L, 36R. As depicted in FIG. 2, the length L of the middle bridge structure 40 extends along or is coextensive with the entire length of each of the longitudinal supports 36L, 36R. In other embodiments, the length L extends along at least 75% of the length of each of the longitudinal supports 36L, 36R.

Referring to FIG. 2, openings 42 44 can be defined through the middle bridge structure 40. The openings 42 are adapted to receive containers or boxes that define storage compartments accessible from the front casing deck. Opening 44 provides access to the interior of the hull 35 for providing access to equipment within the hull such as bilge pumps, sonar transducers or other equipment.

The middle bridge structure 40 can also be referred to as an "intermediate support structure" or a "middle support structure" or a middle floor-support structure." The middle bridge structure 40 extends over an open "flood chamber" region 140 (see FIG. 4) that is preferably not filled with buoyant material (e.g., foam). In the event water enters the interior of the hull, the open flood chamber allows the water to flow down along the keel line to the stem of the boat where a bilge pump is used to remove the water from the hull.

C. Port and Starboard Floor Supporting Portions of Stringer Unit

The port floor support structure 50 of the stringer unit 31 extends from the left longitudinal support 36L to the port side 24 of the hull 35. A port flange 51 extends from the port floor support structure 50 upwardly along the inside surface of the hull 35 (see FIG. 4). The port flange 51 can be bonded to the inner surface of the port side 24 of the hull 35 at a location above a port side chine 120.

The starboard floor support structure 52 extends from the right longitudinal support 36R to the starboard side 26 of the hull 35. A starboard flange 53 extends upwardly from the starboard floor support structure 52 along the inside surface of the starboard side of the hull 35. The starboard flange 53 can be adhesively bonded to the starboard side of the hull 35 at a location above a starboard side chine.

Preferably, the supports structures 50, 52 each have lengths in the longitudinal direction that extend along at least 50 percent of the lengths of the longitudinal supports 36L, 36R so as to provide outer support along a majority of the length of each longitudinal support 36L, 36R. As shown in FIG. 2, the support structures 50, 52 extend along the entire length of each of the longitudinal supports 36L, 36R.

In the above-described embodiment, the flanges 51, 53 are connected to the hull at locations above the chines. It will be appreciated that in lower profile embodiments, the flanges can be connected to the hull below the chines.

D. Front Nose of Stringer Unit

As shown in FIG. 2, adjacent the bow 28 of the boat, the middle bridge structure 40 merges with the port floor support structure 50 and the starboard floor support structure 52 to define the front nose 56. The top surface of the middle bridge structure 40 is preferably coplanar with the top surfaces of the port floor support structure 50 and the starboard floor support structure 52. However, the front nose 56 of the reinforcing structure is preferably angled downwardly relative to the top surfaces of the middle bridge structure 40 and the floor support structures 50, 52. The front nose 56 begins to angle downward at line 58 located adjacent the termination points of the longitudinal supports 36L, 36R. As described below, the angled nose facilitates alignment of the stringer unit within the hull during assembly.

E. Unitary Construction of Stringer System

The term "unitarily connected" means that two parts are connected by a seamless connection without requiring the use of fastening structures such as adhesive or fasteners. In a preferred embodiment, the stringer unit 31 has a unitary construction in which the port floor support structure 50 is unitarily connected to the left longitudinal support 36L, the starboard floor support structure 52 is unitarily connected to the right longitudinal support 36R, and the middle bridge structure 40 is unitarily connected to both the left and right longitudinal supports 36L, 36R. In one example unitary construction, the port floor support structure 50, the left longitudinal support 36L, the middle bridge structure 40, the right longitudinal support 36R and the starboard floor support structure 52 are all formed from a continuous, uninterrupted layer of fiber reinforced resin. Example fibers for reinforcing the resin include glass fiber, carbon fiber, Kevlar or other fibrous material. In other embodiments, the stringer unit can have a non-unitary construction.

F. Cross-Braces

Referring to FIG. 2, the reinforcing insert includes a plurality of cross-braces 90 that extend in a transverse direction relative to the keel line 22. While three cross-braces 90 are shown in FIG. 2, it will be appreciated that the number of cross-braces could be increased or decreased without departing from the principles of the present invention. The cross-braces 90 can be made of any number of different types of material. Example materials include linear foam, wood, plastic, polymeric materials, composites of the above materials, or any number of different other materials.

Referring still to FIGS. 2 and 3, the cross-braces 90 are mounted within open slots or notches 92 defined by the stringer unit 31. As best shown in FIG. 3, each of the notches 92 includes an intermediate portion 94 defined by the middle bridge structure 40, a port portion 96 defined by the port floor support structure 50, and a starboard portion 98 defined by the starboard floor support structure 52. As shown in FIG. 3, the depth of the mid-portions 94 of the notches 92 is less than the height of the inner walls 72 of the longitudinal supports 36L, 36R. Also, the depth of the port and starboard portions 96, 98 of the notches 92 are preferably less than the height of the outer walls 74 of the longitudinal support members 36L, 36R.

Figure 5:
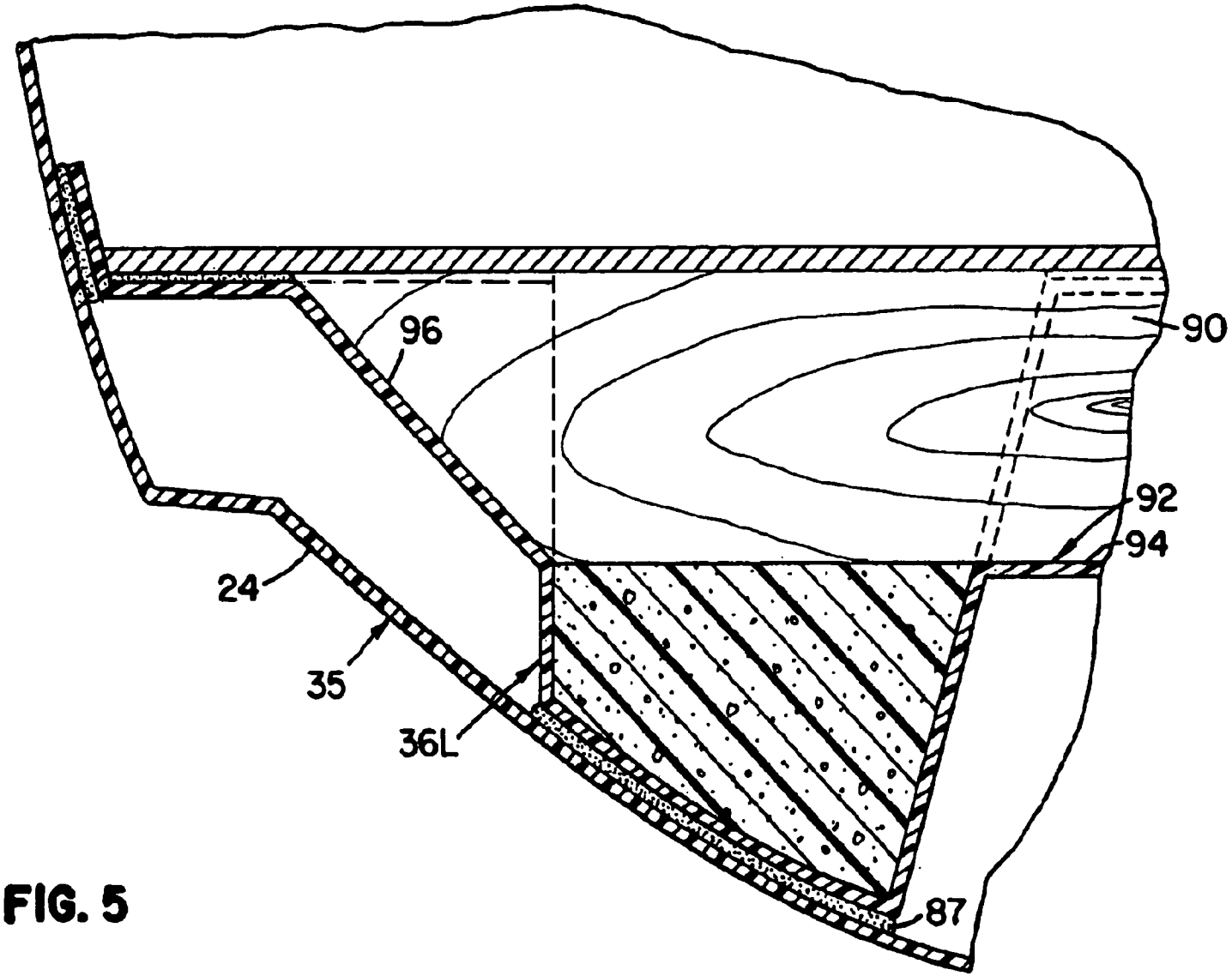
FIG. 5 is a cross-sectional view taken along section 5—5 of FIG. 2.

Referring to FIG. 5, it is preferred for the port and starboard portions 96, 98 of the notches 92 to be configured such that ends 99 of the cross-braces 90 are offset from the hull 35. However, in alternative embodiments, the system can be arranged such that the cross-braces 90 extend completely to the hull.

It will be appreciated that the stringer unit 31 and the cross-braces 90 need not be made of the same type of material. For example, in one embodiment, the stringer unit 31 is manufactured from fiber-reinforced resin, and the cross-braces 90 are manufactured from a material such as linear foam.

When mounted within the notches 92, the cross-braces 90 extend from the middle portions 94 of the notches, through the channels 75 of the left and right longitudinal supports 36L, 36R to the port and starboard portions 96, 98 of the notches 92.

G. Floor Structure

In addition to supporting the hull to minimize flex points, the reinforcing system also provides a base for supporting the floor structure 43 of the boat 20. The floor structure 43 can be a floor, or a subfloor that supports a floor or supports any other type of structure for supporting a floor (e.g., a structural framework). In the example embodiment, the floor structure 43 is a subfloor that extends generally from the stern 30 to the bow 28. The subfloor is bonded (e.g., with adhesive) to the top surface of the middle bridge structure 40 as well as to the top surfaces of the port and starboard floor support structures 50, 52. Thus, the floor structure 43 is supported by the middle bridge structure 40 and the port and starboard support structures 50, 52, and extends over the top sides of the open channels 75 of the longitudinal supports 36L, 36R.

Adjacent the bow 28 of the boat 20, an additional framework of support members (not shown) can be provided above the floor structure 43 to support the front casting platform 36 of the boat 20. A similar framework can be provided adjacent the stern for supporting the rear casting platform 39.

Referring to FIG. 1, a top deck unit 79 is mounted over the top of the hull. The top deck unit 79 includes a front casting platform floor 36' supported above the floor structure 43 by the framework at the front of the boat, a rear casting deck floor 39' supported above the floor structure 43' by the framework at the rear of the boat, and a cockpit floor 37' bonded to the floor structure 43 at the cockpit 37. The top deck piece also includes gunnels 77 that extend generally about the perimeter of the boat, and inner side walls 75 that extend from the gunnels 77 to the cockpit floor 37'. The integrated rear bucket seat unit 33, steering console 34 and other structures located aft of the elevated front casting deck 36 can be mounted directly on the cockpit floor 37'.

The floor structure can be made of any number of different types of material. Example materials include linear foam, wood, polymeric materials, fiber reinforced resin, composite materials as well as other materials. The floor structure 43 and the stringer unit 31 need not be made of the same type of material. For example, in one embodiment, the stringer unit 31 can be made of fiber-reinforced resin, and the floor structure can be made of linear foam.

H. Example Manufacturing Method

An example technique for manufacturing the boat 20 is described in the following paragraphs. It will be appreciated that the method is for illustration purposes, and that other methods could also be used.

Initially, the hull 35 is formed by applying a layer of fiber-reinforced resin to the inner surface of a first open mold. The inner surface of the first open mold has the contour and design of the outer surface of the particular boat hull, desired to be manufactured.

Fiber-reinforced resin is also applied to a second open mold. The second open mold has an inner surface that matches the shape and contour of the stringer unit 31. The layer of fiber-reinforced resin is applied to the mold to form the edge flanges 51, 53, the port and starboard floor supporting structures 50, 52, the longitudinal supports 36L, 36R, the middle bridge structure 40, and the front nose portion 56. Thus, the various components of the stringer unit 31 are integrally molded as a single, integral/unitary piece made of fiber-reinforced resin. After the resin has cured, the cross-braces 90 are inserted into the notches 92. Preferably a bonding material is used to secure the cross-braces 90 within the notches 92. Example bonding materials include fiber reinforced resins, adhesives, bonding compounds, cements, or other materials having like characteristics.

After the cross-braces 90 have been mounted within the notches, the floor structure 43 is preferably bonded to the topside of the stringer unit 31 to form a reinforcing insert. For example, the floor structure 43 can be bonded (e.g., with adhesives, resins, epoxies, or other materials having like bonding characteristic) to the middle bridge structure 40 as well as the port and starboard floor support structures 50, 52. Thereafter, the reinforcing insert can be removed from its mold and inserted into the hull 35, which was previously allowed to cure.

Prior to inserting the reinforcing insert into the hull 35, a bonding compound is preferably applied to the bottom sides of the bottom walls 70 of the longitudinal supports 36L, 36R as well as to the outer surfaces of the edge/perimeter flanges 51, 53. When the reinforcing insert is inserted into the hull 35, the insert nests within the hull 35 with the edge flanges 51, 53 being positioned above the chines 120, and the bottom walls 70 of the longitudinal supports 36L, 36R being positioned below the chines 120. In lower profile embodiments, the flanges 51, 53 and the bottom walls 70 can be positioned below the chines.

The bottom walls 70 are preferably angled to match the V-shaped angle of the hull 35. Thus, because of the angled configuration of the bottom walls 70, the longitudinal supports 36L, 36R provide a self-aligning feature, which assists in centering the reinforcing insert within the hull 35. During insertion of the reinforcing insert, the front nose 56 fits snuggly within the bow of the boat 20 to further enhance the self-aligning feature of the reinforcing insert.

Figure 6:
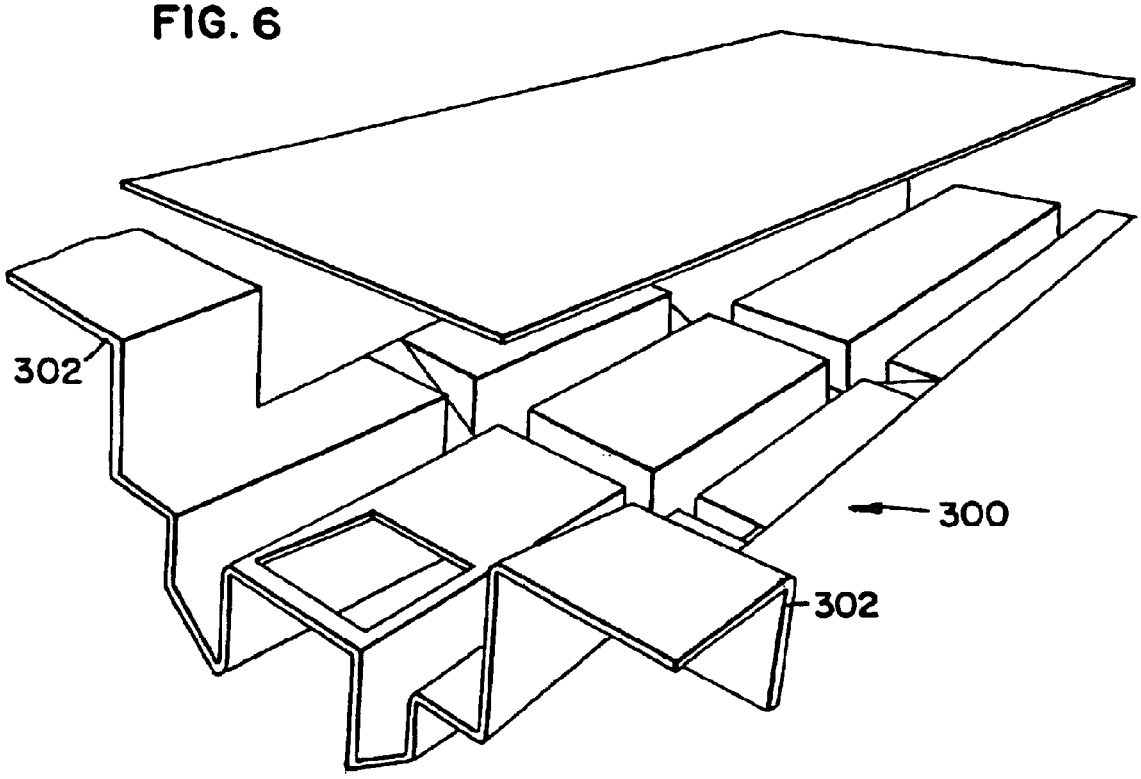
FIG. 6 is a perspective view of an alternative stringer system.
Figure 7:
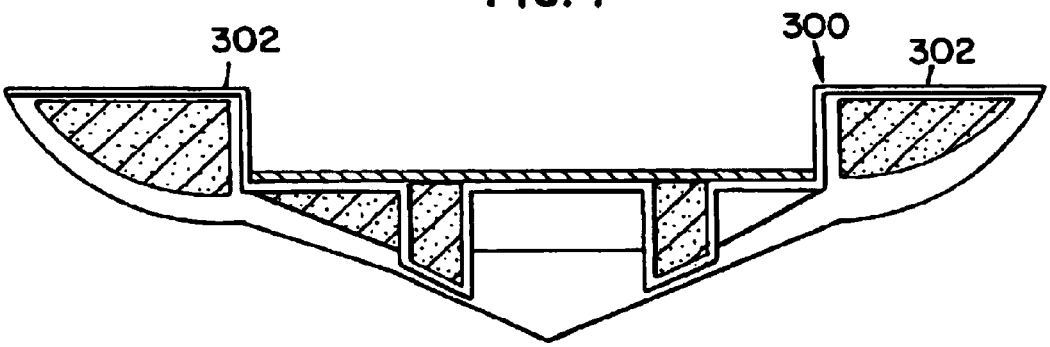
FIG. 7 shows the stringer system of FIG. 6 mounted within a hull.

After the reinforcing insert is mounted within the hull 35, holes can be drilled through the floor structure to allow a buoyant material 85 (see FIGS. 4 and 5) such as an expanding foam (e.g., polyurethane foam) to be injected into the channels of the left and right longitudinal supports 36L, 36R. The buoyant material can also be injected into other regions between the hull 35 and the stringer unit 31 (e.g., beneath the port and starboard floor supporting structures 50, 52. Buoyant boxes or blocks (e.g., blocks of foam) can also be provided at the stem of the boat adjacent the port and starboard corners to provide additional floatation for the motor. FIGS. 6 and 7 show an alternative embodiment including a stringer system 300 having the same configuration as the stringer system of FIG. 2, with the addition of integral rear boxes 302 for housing blocks of buoyant material adjacent the rear port and starboard corners of the boat.

Once the reinforcing insert is secured within the hull 35, the top deck unit 79 can be bonded to the hull 35 and the floor structure 43. Thereafter, other components such as steering console 34, integrated rear bucket seat unit 33 and other structures can be structurally coupled to the top deck unit 79.

With regard to the forgoing description, it is to be understood that changes may be made in detail, especially with respect to the shape, size and arrangement of the parts. It is intended that the specification and depicted aspects be considered illustrative only and not limiting with respect to the broad underlying concepts of the present disclosure.

I claim:

1. A boat comprising:

A) a hull including a keel, a starboard side and a port side;

B) a system for reinforcing the hull, the system including first longitudinal support positioned starboard of the keel and a second support positioned port of the keel, each of the first and second longitudinal supports including:

i) a bottom wall that extends along the hull and is bonded to the hull, the bottom wall including inner and outer ends;

ii) an inner wall that extends upwardly away from the hull, the inner wall being connected to the inner end of the bottom wall; and iii) an outer wall that extends upwardly away from the hull, the outer wall connected to the outer end of the bottom wall;

C) wherein the bottom wall and the inner and outer walls of the first and second longitudinal supports defining first and second channels having open sides that face in an upward direction, the first and second channels each having a length that extends in a longitudinal direction;

D) and wherein the inner walls of the first and second longitudinal supports include upper ends that are interconnected by a bridge structure, the bridge structure spanning the keel and being configured to support a floor structure, the inner walls of the first and second longitudinal supports and the bridge structure defining an intermediate channel having an open side that faces in a downward direction, the intermediate channel being located over the keel.

2. The boat of claim 1, wherein the inner walls are unitarily connected to the bridge structure.

3. The boat of claim 2, further comprising a floor structure bonded to a top surface of the bridge structure, the floor structure extending over the open sides of the first and second channels.

4. The boat of claim 3, wherein the outer walls of the longitudinal supports include upper ends, and wherein the boat further includes a starboard floor supporting structure that extends from the starboard side of the hull to the upper end of the outer wall of the first longitudinal support, and a port floor supporting structure that extends from the port side of the hull to the upper end of the outer wall of the second longitudinal support.

5. The boat of claim 4, wherein the bridge structure, the starboard floor supporting structure and the port floor supporting structure cooperate to define a transverse notch in which a cross-brace is positioned.

6. The boat of claim 5, wherein the cross-brace extends transversely through the first and second channels.

7. The boat of claim 6, wherein the first and second channels are filled with a buoyant material.

8. The boat of claim 1, wherein the bridge structure does not extend across the open sides of the first and second channels.

9. The boat of claim 1, wherein the inner walls, the outer walls, the bottom walls and the bridge structure are all defined by a continuous, uninterrupted layer of fiber reinforced resin.

10. The boat of claim 1, wherein the bridge structure has a longitudinal dimension and a transverse dimension, the longitudinal dimension being greater than the transverse dimension.

11. The boat of claim 1, wherein the bridge structure defines at least one transverse slot, and wherein a cross-brace is positioned within the transverse slot.

12. The boat of claim 11, wherein the bridge structure defines at least two transverse slots that are spaced-apart in a longitudinal direction, and wherein cross-braces are positioned within the transverse slots.

13. The boat of claim 12, wherein the transverse slots are upwardly opening slots each having a depth that is less than a height of the inner walls of the first and second longitudinal supports.

14. A boat comprising:

a fiber reinforced resin hull including a keel, a starboard side and a port side;

a stringer system for reinforcing the hull, the stringer system including a first longitudinal support positioned starboard of the keel and a second longitudinal support positioned port of the keel;

a bridge structure that interconnects the first and second longitudinal supports, the bridge structure being spaced above the keel and configured to support a floor structure, the bridge structure extending over the keel and spanning a distance between the first and second longitudinal supports, the bridge structure extending along at least 50 percent of the length of each of the first and second reinforcing structures; and the bridge structure and the first and second longitudinal supports being formed from a continuous, uninterrupted layer of fiber reinforced resin, the bridge structure and the first and second longitudinal supports defining a downwardly open channel located over the keel.

15. The boat of claim 14, wherein the bridge structure defines at least one transverse slot, and wherein a cross-brace is positioned within the transverse slot.

16. The boat of claim 15, wherein the bridge structure defines at least two generally parallel transverse slots, and wherein cross-braces are positioned within the transverse slots.

17. The boat of claim 16, wherein the transverse slots are upwardly opening slots each having a depth that is less than a height of the first and second longitudinal supports.

18. The boat of claim 14, first comprising a starboard floor supporting structure that extends from the first longitudinal support to the starboard side of the hull, and a port floor supporting structure that extends from the second longitudinal support to the port side of the hull, the starboard floor supporting structure being unitarily connected with the first longitudinal support and the port floor supporting structure being unitarily connected with the second longitudinal support.

19. The boat of claim 18, further comprising a floor structure supported above the bridge structure, the starboard floor supporting structure and the port floor supporting structure.

20. The boat of claim 19, wherein the floor structure is bonded to the bridge structure, the starboard floor supporting structure and the port floor supporting structure.

21. The boat of claim 14, wherein each of the longitudinal supports defines an upwardly open channel.

22. A boat comprising:

a hull including a keel, a starboard side and a port side;

a stringer system for reinforcing the hull, the stringer system including a first longitudinal support positioned starboard of the keel and a second longitudinal support positioned port of the keel;

a middle structure that extends across the keel and interconnects the first and second reinforcing structures, the middle structure extending along at least 50 percent of the length of each of the first and second longitudinal supports; and the middle structure defining at least one transverse slot in which a cross-brace is positioned.

23. The boat of claim 22, wherein the middle structure defines at least two generally parallel transverse slots, and wherein cross-braces are positioned within the transverse slots.

24. The boat of claim 23, wherein the transverse slots open in an upward direction, and each have a depth less than a height of each of the longitudinal supports.

25. The boat of claim 22, further comprising a starboard support structure that extends toward the starboard side of the hull from the first longitudinal support and a port support structure that extends toward the port side of the hull from the second longitudinal support.

26. The boat of claim 25, wherein the at least one transverse slot extends through the middle support structure, the starboard support structure and the port support structure.

27. The boat of claim 26, wherein top surfaces of the middle structure, the starboard support structure and the port support structure are generally co-planar.

28. A method for making a boat comprising:

forming a hull having a keel;

forming a stringer piece including first and second spaced-apart channel portions and an intermediate channel portion located between the first and second channel portions, the first, second, and intermediate channel portions each having an open side positioned opposite from a closed side;

securing a floor structure over a top side of the stringer piece such that the open sides of the first and second channel portions are covered;

positioning the stringer piece within the hull with the first and second channel portions positioned on opposite sides of the keel, and with the intermediate channel portion located over the keel and extending across the keel, the closed side of the intermediate channel portion being located adjacent to the floor structure for supporting the floor structure, and the closed sides of the first and second channel portions being located adjacent to the hull; and bonding the closed sides of the first and second channel portions to the hull.

29. The method of claim 28, wherein the hull is V-shaped, and the closed sides of the first and second channel portions are angled to match the hull.

30. The method of claim 28, wherein the first, second and intermediate channel portions are unitarily formed by applying fiber reinforced resin to an open face mold.

31. The boat of claim 1, wherein the intermediate channel defines an open region extending along the keel of the hull.

32. The boat of claim 1, wherein the bridge structure that interconnects the upper ends of the inner walls of the first and second longitudinal supports is a planar bridge structure.

33. The boat of claim 14, wherein the downwardly open channel defines an open region extending along the keel of the hull.

34. The boat of claim 14, wherein the bridge structure that interconnects the first and second longitudinal supports is a planar bridge structure.

35. The method of claim 28, wherein the intermediate channel portion defines an open region extending along the keel of the hull.

* * * * *